US008144173B2

(12) United States Patent
Baba et al.

(10) Patent No.: US 8,144,173 B2
(45) Date of Patent: Mar. 27, 2012

(54) IMAGE PROCESSING APPARATUS AND IMAGE DISPLAY APPARATUS

(75) Inventors: Masahiro Baba, Yokohama (JP); Ryosuke Nonaka, Kawasaki (JP); Yuma Sano, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/877,227

(22) Filed: Sep. 8, 2010

(65) Prior Publication Data

US 2011/0025728 A1 Feb. 3, 2011

Related U.S. Application Data

(63) Continuation of application No. PCT/JP2009/070619, filed on Dec. 9, 2009.

(30) Foreign Application Priority Data

Dec. 25, 2008 (JP) ..... 2008-331348

(51) Int. Cl.
*G09G 5/10* (2006.01)

(52) U.S. Cl. ..... 345/690; 345/102; 349/1; 362/611

(58) Field of Classification Search ..... 345/87–89, 345/102, 690; 349/1, 5, 6; 362/611, 612
See application file for complete search history.

(56) References Cited

U.S. PATENT DOCUMENTS 5,945,965 A * 8/1999 Inoguchi et al. ..... 345/6
6,803,901 B1 10/2004 Numao
2004/0017348 A1 1/2004 Numao
2006/0214904 A1 9/2006 Kimura et al.
2009/0213145 A1* 8/2009 Onizawa ..... 345/690
2009/0289890 A1* 11/2009 Tsuchida et al. ..... 345/102
2009/0290091 A1* 11/2009 Tsuchida et al. ..... 349/61
2010/0053222 A1* 3/2010 Kerofsky ..... 345/690
2010/0120471 A1* 5/2010 Uchikawa et al. ..... 455/566

FOREIGN PATENT DOCUMENTS

JP 2001-22318 1/2001

(Continued)

OTHER PUBLICATIONS

Office Action issued May 17, 2011, in Japanese Patent Application No. 2008-331348, (with English-language Translation).

(Continued)

*Primary Examiner* — Kimnhung Nguyen
(74) *Attorney, Agent, or Firm* — Oblon, Spivak, McClelland, Maier & Neustadt, L.L.P.

(57) ABSTRACT

According to one embodiment, an apparatus includes following units. The image display unit includes a light source unit provided with light sources, each source being controlled respectively, and a liquid crystal panel displaying on a display area. The luminance calculation unit calculates a light source luminance of the light source based on a signal level of a divided area into which the display area virtually divided. The luminance distribution calculation unit calculates an entire luminance distribution of the light source unit. The transform unit transforms a signal level of the input image into a transformed image based on the entire luminance distribution. The luminance correction unit calculates a correction coefficient based on an average value or a sum of the light source luminance, and collects each of the light source luminance by the correction coefficient. The controller unit controls the liquid crystal panel and the light source unit.

13 Claims, 10 Drawing Sheets

FOREIGN PATENT DOCUMENTS

| | | |
|---|---|---|
| JP | 2001-183622 | 7/2001 |
| JP | 2002-99250 | 4/2002 |
| JP | 2004-198512 | 7/2004 |
| JP | 2004-350179 | 12/2004 |
| JP | 2005-309338 | 11/2005 |
| JP | 2007-34251 | 2/2007 |
| JP | 2007-241236 | 9/2007 |
| JP | 2008-304908 | 12/2008 |
| KR | 10-2006-0103399 | 9/2006 |

OTHER PUBLICATIONS

Office Action issued Sep. 16, 2011, in Korean Patent Application No. 10-2010-7015600, (w/English Translation), pp. 1-9.

* cited by examiner

IMAGE PROCESSING APPARATUS AND IMAGE DISPLAY APPARATUS

CROSS REFERENCE TO RELATED APPLICATIONS

This is a Continuation Application of PCT Application No. PCT/JP2009/070619, filed Dec. 9, 2009, which was published under PCT Article 21(2) in Japanese.

This application is based upon and claims the benefit of priority from Japanese Patent Application No. 2008-331348, filed Dec. 25, 2008; the entire contents of which are incorporated herein by reference.

FIELD

Embodiments described herein relate generally to an image processing apparatus capable of visually enhancing the contrast of an image, and an image display apparatus including the image processing apparatus.

BACKGROUND

Image display apparatuses, which are represented by liquid crystal display apparatuses and equipped with light sources, and light modulation elements for modulating the intensity of the light emitted from each light source, are now widely used. In the image display apparatuses with the light modulation elements, the contrast of images may well be degraded, because of leakage of light from the light modulation elements, especially when black is displayed. The leakage of light will occur because the light modulation elements do not have ideal modulation characteristics. Further, in these image display apparatuses, the light source luminance is kept constant between different images. Accordingly, it is difficult to realize such highly dynamic range display as in a cathode ray tube (CRT), in which when the average luminance of an input image is high, the display luminance is reduced to suppress glare, and when the average luminance of an input image is low, the display luminance is increased, thereby realizing so-called "sparkling."

To suppress reduction of contrast in a liquid crystal display apparatus, JP-A 2005-309338 (KOKAI), for example, has proposed a method of providing luminance variable light sources in a plurality of areas on the screen, and executing both the modulation of the luminances of the light sources in accordance with an input image, and the signal level transform of each pixel of the input image.

Further, to enable a liquid crystal display apparatus to perform an operation equivalent to so-called automatic brightness limiter (ABL) control that is executed to realize highly dynamic range display on a CRT, JP-A 2004-350179 (KOKAI), for example, has proposed a method of calculating the average picture level (APL) of an input image, reducing the brightness of a light source if the APL is high, and increasing the brightness if the APL is low.

In both the above-mentioned techniques, such highly dynamic range display as in a CRT is realized by controlling the luminances of the light sources in accordance with the APL of the input image. However, when the process of calculating the APL of the input image is realized by a circuit, if the input image is formed of a large number of pixels like a high definition television (HDTV) image, the scale of the circuit is inevitably extremely increased. Further, when the luminances of the light sources are controlled in accordance with the APL of the input image, it is difficult to control the luminances while limiting the consumption of power, since correlation does not necessarily exist between the APL and the consumption power of the light sources.

DETAILED DESCRIPTION

First Embodiment

Figure 1:
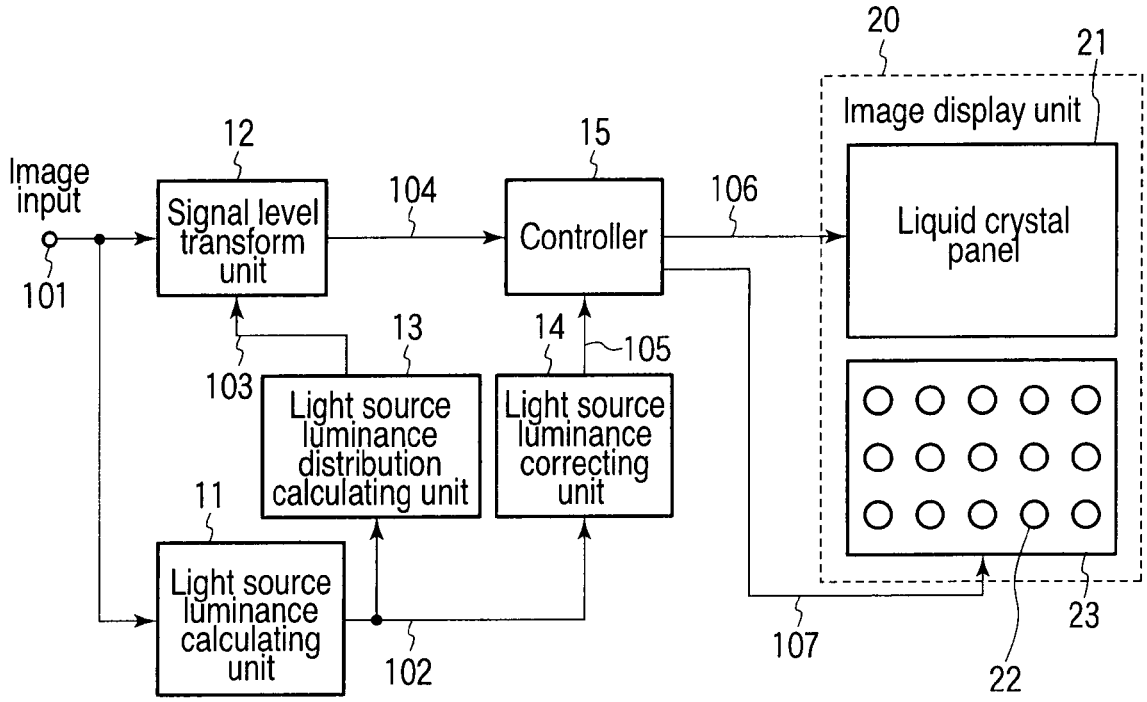
FIG. 1 is a block diagram illustrating an image display apparatus including an image processing apparatus, according to a first embodiment.

In general, according to one embodiment, an apparatus includes following units. The image display unit includes a light source unit provided with light sources, each source being controlled respectively, and a liquid crystal panel displaying on a display area. The luminance calculation unit calculates a light source luminance of the light source based on a signal level of a divided area into which the display area virtually divided. The luminance distribution calculation unit calculates an entire luminance distribution of the light source unit. The transform unit transforms a signal level of the input image into a transformed image based on the entire luminance distribution. The luminance correction unit calculates a correction coefficient based on an average value or a sum of the light source luminance, and collects each of the light source luminance by the correction coefficient. The controller unit controls the liquid crystal panel and the light source unit. FIG. 1 shows an image display apparatus including an image processing apparatus, according to a first embodiment. The image processing apparatus comprises a light source luminance calculating unit 11, a signal level transform unit 12, a light source luminance distribution calculating unit 13, a light source luminance correcting unit 14, and a controller 15. The image processing apparatus controls an image display unit 20.

The image display unit 20 is a transmissive liquid crystal display unit comprising a liquid crystal panel 21 as a light modulation element, and a light source unit (hereinafter referred to as "the backlight") 23 that includes a plurality of light sources 22 provided on the backside of the liquid crystal panel 21.

An input image 101 is input to the light source luminance calculating unit 11 and the signal level transform unit 12. The light source luminance calculating unit 11 calculates the light source luminance 102 of each light source 22 based on information indicating signal levels that correspond to the respective divisional areas of the input image 101. In other words, light source luminances 102 calculated in this process represent the luminances of the light sources 22 tentatively determined from the divisional area information of the input image 101 that correspond to the light sources 22. The information indicating the thus-calculated light source luminances 102 is input to the light source luminance distribution calculating unit 13 and the light source luminance correcting unit 14.

Based on the luminance distribution of each light source 22 of the backlight 23 (hereinafter referred to as "the individual luminance distribution") assumed when said each light source 22 emits light individually, the light source luminance distribution calculating unit 13 calculates the luminance distribution of the entire backlight 23 (hereinafter referred to as "the whole luminance distribution 103") assumed when the light sources 22 simultaneously emit light with a certain luminance. The information indicating the calculated whole luminance distribution 103 is input to the signal level transform unit 12. Based on the whole luminance distribution 103, the signal level transform unit 12 executes signal level transform on each pixel of the input image 101, and outputs a signal level transformed image 104.

The light source luminance correcting unit 14 includes a correction coefficient calculating unit that calculates, from the information on the light source luminances 102, the luminance average of the light sources 22 in a preset period (e.g., one frame period), which will hereinafter be referred to as "the average light source luminance." The correction coefficient calculating unit then calculates a correction coefficient that is decreased as the average light source luminance increases. Based on the thus-calculated correction coefficient, the light source luminance correcting unit 14 corrects the luminance 102 of each light source 22, and outputs information on the corrected light source luminance 105.

The controller 15 controls the output timing of the signal indicating the transformed image 104 and output from the signal level transform unit 12, and the output timing of the corrected light source luminance 105 calculated by the light source luminance correcting unit 14, supplies the liquid crystal panel 21 with a complex image signal 106 generated based on the transformed image 104, and supplies the backlight 23 with a luminance control signal 107 generated based on the corrected light source luminance 105.

In the image display unit 20, the complex image signal 106 is applied to the liquid crystal panel 21, and each light source 22 of the backlight 23 emits light with a luminance based on the luminance control signal 107, thereby displaying an image. Each element of FIG. 1 will now be described in more detail.

(Light Source Luminance Calculating Unit 11)

Figure 2:
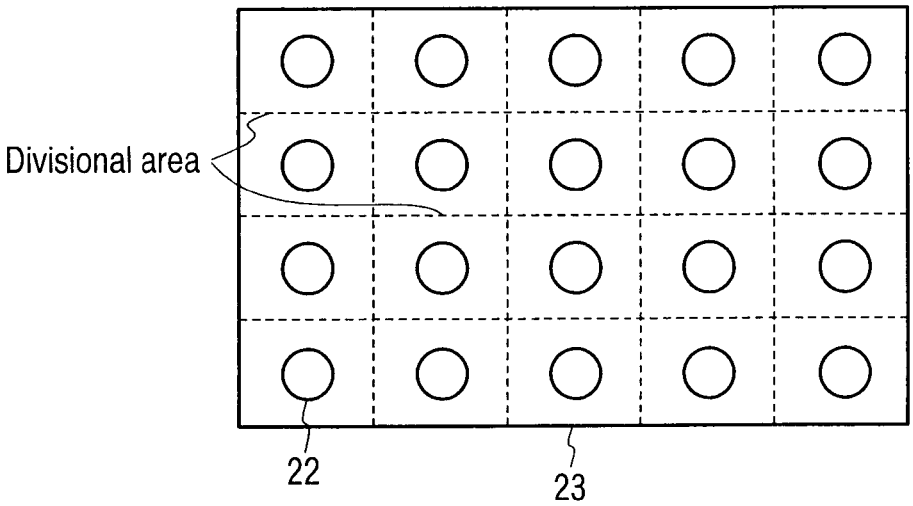
FIG. 2 is a view useful in explaining the relationship between each light source of a backlight and each divisional area of an input image.

The light source luminance calculating unit 11 calculates the luminance (hereinafter referred to as "the light source luminance") 102 of each light source 22 of the backlight 23. In the first embodiment, the input image 101 is tentatively divided into a plurality of areas corresponding to the light sources 22 of the backlight 23, and the light source luminance calculating unit 11 calculates the light source luminance 102 using information related to each divisional area of the input image 101. For example, in such a backlight 23 as shown in FIG. 2 in which there are five horizontal light sources 22 and four vertical light sources 22, the input image 101 is divided into 5×4 divisional areas as indicated by the broken lines, so that they correspond to the light sources 22, and the maximum signal level of the input image 101 in each divisional area is calculated.

Based on the maximum signal level calculated in each divisional area, the light source luminance calculating unit 11 calculates the luminance of the light source 22 corresponding to said each divisional area. For instance, if the input image 101 is expressed by an 8-bit digital value, it can have 256 signal levels ranging from $0^{th}$ to $255^{th}$ levels. In this case, assuming that the maximum signal level of the $i^{th}$ divisional area is $L_{max}(i)$, the light source luminance is given by the following equation (1):

$$I(i) = \left(\frac{L_{max}(i)}{255}\right)^{\gamma} \tag{1}$$

where γ is a gamma value, which is generally 2.2, and I(i) represents the luminance of the $i^{th}$ light source. Namely, the light source luminance calculating unit 11 calculates the maximum signal level $L_{max}(i)$ in each divisional area of the input image 101, divides the maximum signal level $L_{max}(i)$ by the maximum signal level (in this case, "255") that input image 101 can have, and corrects the resultant value by the gamma value, thereby calculating the light source luminance I(i).

To obtain the light source luminance I(i), a lookup table (LUT) may be used instead of the equation (1). Namely, the relationship between $L_{max}(i)$ and I(i) may be beforehand calculated, and be stored in association with each other in the LUT incorporated in, for example, a read only memory (ROM), and the light source luminance I(i) be obtained referring to the LUT. Even when the light source luminance is obtained using the LUT, certain calculation processing is involved, and hence the unit for obtaining the light source luminance is called a light source luminance calculating unit 11.

Although in the first embodiment, one divisional area of the input image 101 is made to correspond to one light source 22 of the backlight 23, it may be made to correspond to a plurality of adjacent light sources 22 included in the backlight 23. Further, the input image 101 may be evenly divided into areas corresponding to the light sources 22 as shown FIG. 2. Alternatively, the divisional areas may be set so that they overlap each other.

The information on the luminance 102 of each light source 22 calculated by the light source luminance calculating unit 11 is input to the light source luminance distribution calculating unit 13 and the light source luminance correcting unit 14.

(Light Source Luminance Distribution Calculating Unit 13)

The light source luminance distribution calculating unit 13 calculates, as recited below, the whole luminance distribution 103 of the backlight 23 based on the luminance 102 of each light source 22.

Figure 3:
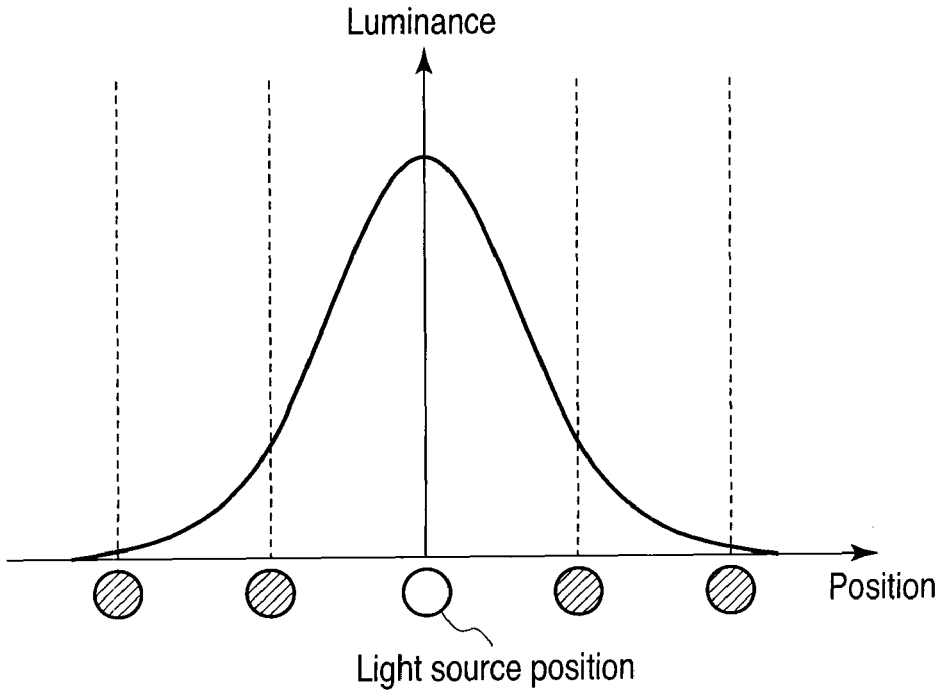
FIG. 3 is a view illustrating a light source luminance distribution assumed when only one light source of the backlight is lit.

FIG. 3 shows a light source luminance distribution assumed when only one light source of light sources 22 of the backlight 23 is lit. In FIG. 3, for facilitating the explanation, the luminance distribution is expressed one-dimensionally, the horizontal axis indicting the position, the vertical axis indicating the luminance. Further, in the case of FIG. 3, the circles below the horizontal axis denote the positions of light sources 22, and the white circle at the center denotes that only the light source at this position is lit. As can be understood from FIG. 3, the luminance distribution assumed when only one light source is lit diverges to neighboring light sources.

Figure 4:
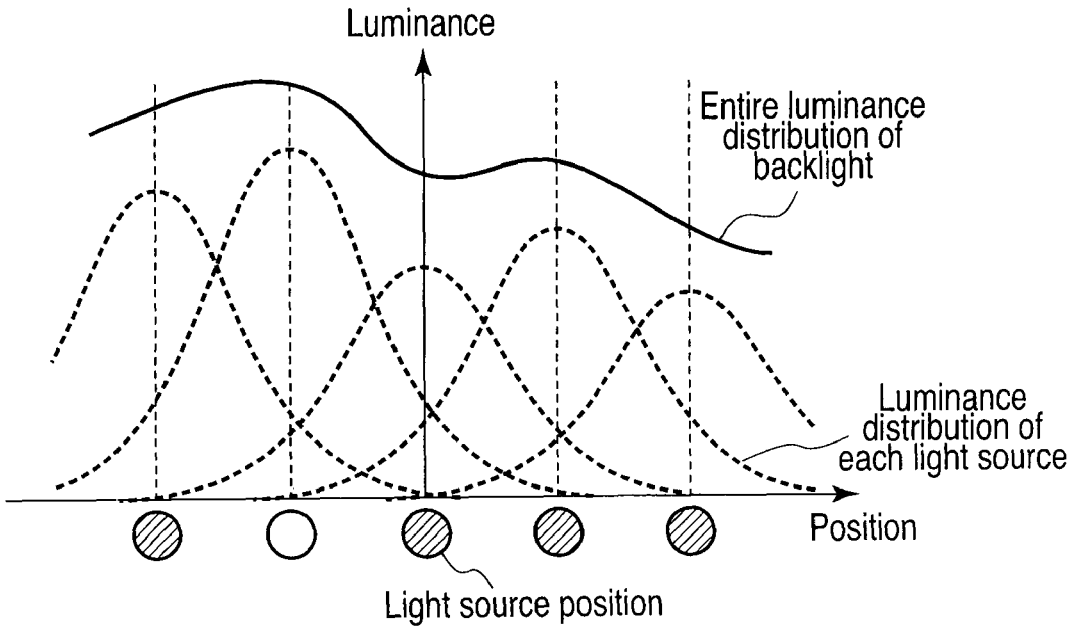
FIG. 4 is a view illustrating the light source luminance distribution of each light source and that of the entire backlight, which are assumed when all light sources of the backlight are simultaneously lit.

Therefore, in the light source luminance distribution calculating unit 13, to enable the signal level transform unit 12 to execute signal level transform based on the whole luminance distribution 103 of the backlight 23, the individual luminance distributions of the light sources 22 of the backlight 23, which are indicated by the broken lines of FIG. 4 and based on the luminances 102 of the light sources 22, are synthesized or added to calculate the whole luminance distribution 103 of the backlight 23 indicated by the solid line of FIG. 4.

Specifically, FIG. 4 schematically shows the whole light source luminance distribution 103 assumed when light sources 22 of the backlight 23 are simultaneously lit. In FIG. 4, the luminance distribution is expressed one-dimensionally as in FIG. 3. When the light sources located at the positions indicated by the circles below the horizontal axis are simultaneously lit, the individual light sources have their respective luminance distributions indicated by the broken lines of FIG. 4. By adding the luminance distributions, the whole luminance distribution 103 of the backlight 23 indicated by the solid line of FIG. 4 is obtained.

To calculate the whole luminance distribution 103 indicated by the solid line of FIG. 4, an approximate function associated with the distances from the light sources may be obtained from actually measured values, and be held in the light source luminance distribution calculating unit 13. In the first embodiment, however, the luminance distribution of a certain light source 22 as indicated by the corresponding broken line in FIG. 3 is obtained as the relationship between the distances from the light source and the luminances corresponding to the distances, and the luminance distributions of the other light sources 22 are obtained in the same manner as this A LUT showing the thus-obtained relationship between the distances and the luminances is held in a ROM.

Figure 5:
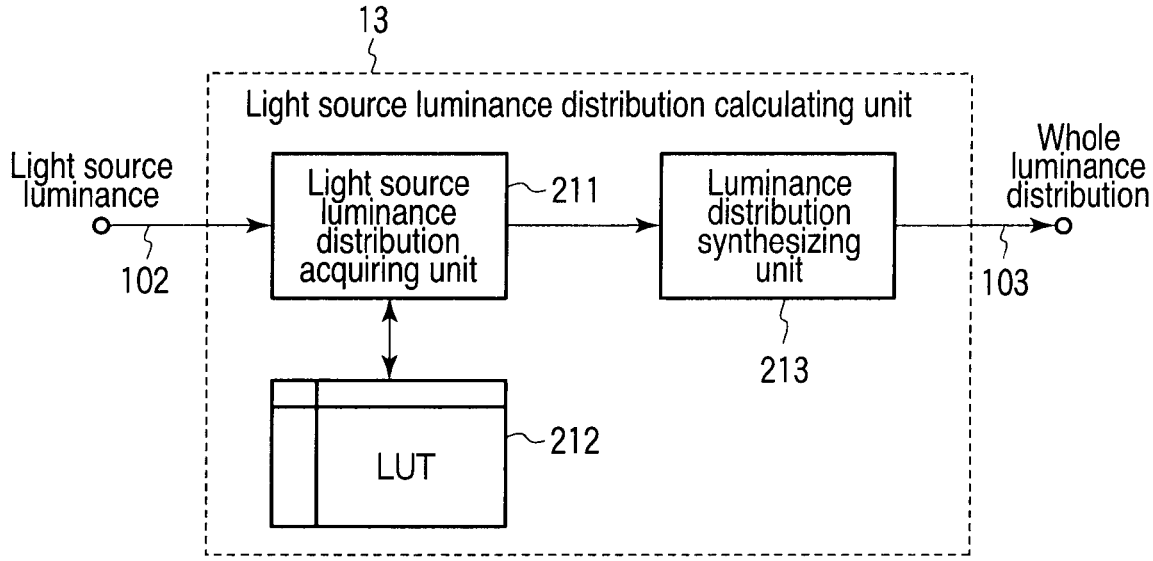
FIG. 5 is a block diagram illustrating in detail a light source luminance distribution calculation unit in the first embodiment.

FIG. 5 shows a specific example of the light source luminance distribution calculating unit 13 of the first embodiment. The information on the light source luminance 102 calculated for a certain light source 22 is input to a light source luminance distribution acquiring unit 211. The light source luminance distribution acquiring unit 211 acquires, from a LUT 212, a luminance distribution corresponding to the certain light source 22, and multiplies the acquired luminance distribution by the light source luminance 102. The same process as the above is repeated on the other light sources 22, whereby the individual luminance distributions corresponding to all light sources 22 and indicated by the broken lines of FIG. 4 are obtained. After that, a luminance distribution synthesizing unit 213 adds up the individual luminance distributions corresponding to all light sources 22, thereby calculating the whole luminance distribution 103 of the backlight 23 as indicated by the solid line of FIG. 4. The information indicating the whole luminance distribution 103 is input to the signal level transform unit 12.

(Signal Level Transform Unit 12)

The signal level transform unit 12 transforms the signal level of each pixel of the input image 101 to thereby form a transformed image 104, based on the whole luminance distribution 103 of the backlight 23 calculated by the light source luminance distribution calculating unit 13.

The light source luminance 102 calculated by the light source luminance distribution calculating unit 13 is set lower than the maximum light source luminance based on the input image 101. Accordingly, to display an image of a desired brightness on the image display unit 20, it is necessary to chance the transmittance of the liquid crystal panel 21, i.e., to transform the signal level of an image signal to be applied to the liquid crystal panel 21. Assuming that the signal levels of the sub pixels of red, green and blue at a pixel position (x, y) on the input image 101 are $L_R(x, y)$, $L_G(x, y)$ and $L_B(x, y)$, respectively, the signal levels $L_R'(x, y)$, $L_G'(x, y)$ and $L_B'(x, y)$ of the red, green and blue sub pixels of the transformed image 104 are computed at:

$$L_R'(x, y) = \frac{L_R(x, y)}{I_d(x, y)^{\frac{1}{\gamma}}} \qquad (2)$$

$$L_G'(x, y) = \frac{L_G(x, y)}{I_d(x, y)^{\frac{1}{\gamma}}}$$

$$L_B'(x, y) = \frac{L_B(x, y)}{I_d(x, y)^{\frac{1}{\gamma}}}$$

where Id(x, y) represents a luminance (pixel associated luminance) associated with the pixel position (x, y) on the input image 101 that corresponds to the whole luminance distribution 103 of the backlight 23 calculated by the light source luminance distribution calculating unit 13.

The signal level transform unit 12 may obtain the signal levels of signal level transformed pixels using the equations (2). Alternatively, it may employ a LUT that holds the signal level L, the luminance Id, and transformed signal level L' in relation to each other, and may obtain the transformed L'(x, y) with reference to the LUT.

From the equations (2), depending upon the values of L and Id, the transformed signal level L' may exceed the maximum signal level of "255." In this case, saturation processing may be executed on the transformed signal level, using "255."

However, the signal level subjected to saturation processing may not represent appropriate signal level, since in the saturation processing, a plurality of signal levels exceeding "255" are transformed into a single saturation value. To avoid this, for example, transformed signal levels held by a LUT may be corrected so that they are gradually varied near the corresponding saturated values.

In the light source luminance calculating unit 11 and the light source luminance distribution calculating unit 13, the light source luminances and the light source luminance distributions are calculated using all signal levels included in one frame of the input image 101. Accordingly, when a certain frame image is input as the input image 101 to the signal level transform unit 12, the light source luminance distributions corresponding to the frame image are not yet calculated. The signal level transform unit 12 incorporates a frame memory. The signal level transform unit 12 temporarily holds the input image 101 in the frame memory to retard processing of the input image by one frame, and then executes signal level transformation on the input image in accordance with the whole luminance distribution 103 of the backlight 23 calculated by the light source luminance distribution calculating unit 13, thereby generating the transformed image 104.

In general, however, since the input image 101 is temporally rather continuous and exhibits high correlation between its successive frames, the transformed image 104 may be obtained by, for example, executing signal level transform on the current frame of the input image in accordance with the whole luminance distribution 103 obtained from the input image one frame before the current frame. In this case, it is not necessary to install, in the signal level transform unit 12, the frame memory for retarding the input image 101 by one frame, thereby reducing the circuit scale.

(Light Source Luminance Correcting Unit 14)

The light source luminance correcting unit 14 multiplies, by a correction coefficient, the luminance 102 of each light source 22 calculated by the light source luminance calculating unit 11, thereby obtaining a corrected light source luminance 105.

Figure 6:
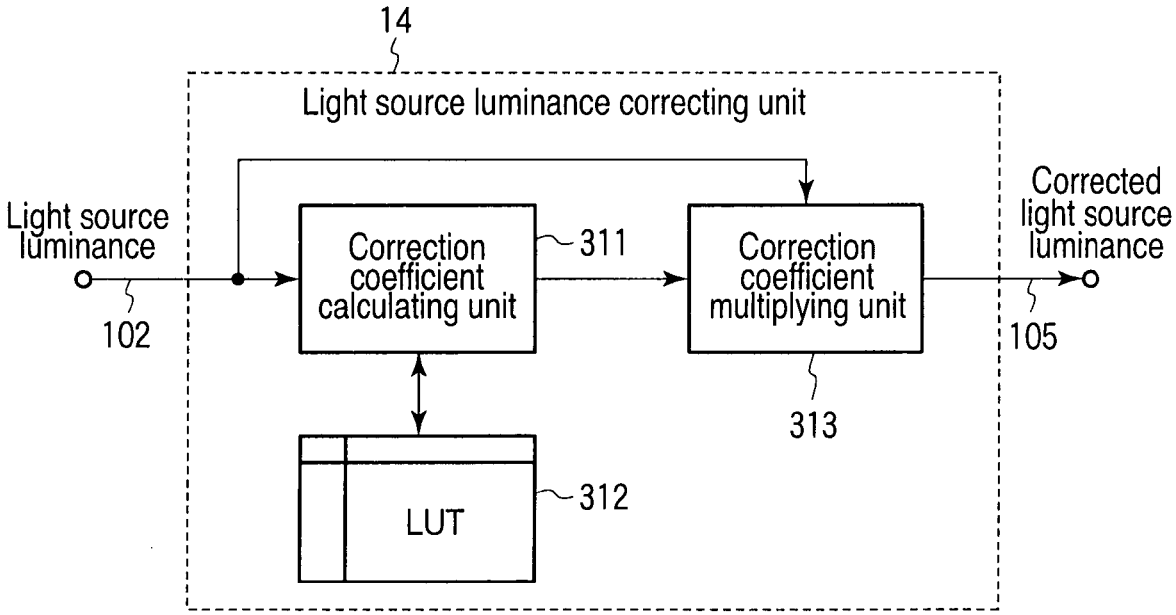
FIG. 6 is a block diagram illustrating in detail a light source luminance correcting unit in the first embodiment.

FIG. 6 shows a specific example of the light source luminance correcting unit 14. The light source luminance correcting unit 14 comprises a correction coefficient calculating unit 311 for calculating a coefficient used to correct the luminances 102 of the light sources 22 calculated by the light source luminance calculating unit 11, a LUT 312 that holds correction coefficients, and a correction coefficient multiplying unit 313 for multiplying each light source luminance 102 by the calculated correction coefficient to obtain the corrected light source luminance 105. Each unit of FIG. 6 will now be described in detail.

The correction coefficient calculating unit 311 firstly calculates the average value (hereinafter, "the average light source luminance") of the luminances 102 of the light sources 22. For example, if the number of light sources 22 is n, the average light source luminance Iave is given by $$I_{ave} = \frac{\sum_{i=0}^{n-1} I(i)}{n} \tag{3}$$

where I(i) represents the $i^{th}$ light source luminance 102. The number n of the light sources 22 is much smaller than the number of pixels, and hence the processing cost can be reduced, compared to the conventional case where the average luminance of the entire image is calculated. In particular, when the input image 101 is an HDTV image formed of an extremely large number of pixels, this advantage is conspicuous. Alternatively, the average of the average values of the luminances 102 of the light sources through a preset period (e.g., two frames period) may be used instead of the average light source luminance lave.

Furthermore, in place of the average light source luminance lave given by the equation (3), the sum (hereinafter, "the light source luminance sum") Isum of the luminances of the light sources 22 given by the following equation may be used:

$$Isum = \sum_{i=0}^{n-1} I(i) \tag{4}$$

In the description below, the average light source luminance lave may be replaced with the light source sum Isum. Further, the sum of the luminances 102 of the light sources 22 obtained during the preset period (e.g., two frames period) may be used in place of Isum.

After that, referring to the LUT 312 holding correction coefficients, the correction coefficient calculating unit 311 obtains a correction coefficient corresponding to the light source luminance 102, based on the calculated average light source luminance lave. The average light source luminance and the correction coefficient held in associated with each other in the LUT 312 can be associated in various ways. Basically, however, the relationship therebetween is set so that the correction coefficient is increased as the average light source luminance is reduced.

Figure 7:
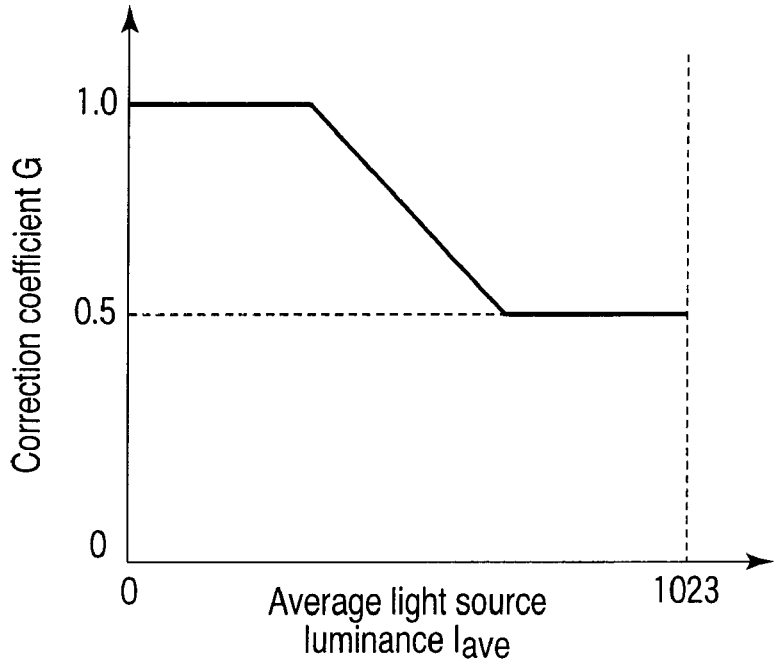
FIG. 7 is a graph illustrating a relationship example between the average light source luminance and the correction coefficient in the first embodiment.

FIG. 7 shows a relationship example between the average light source luminance lave and a correction coefficient G held in the LUT 312. In FIG. 7, in the area in which the average light source luminance lave is less than a preset threshold value, the correction coefficient G is set to a constant value of 1.0. In contrast, in the area in which the average light source luminance lave is not less than the preset threshold value, the correction coefficient G is gradually decreased in accordance with increases in the average light source luminance lave, and reaches a final constant value of 0.5. In the first embodiment, since it is supposed that the luminance of each light source 22 is controlled using 10-bit data, the maximum value of the average light source luminance lave is expressed as "1023," and the correction coefficient G corresponding to "1023" is 0.5.

Instead of holding the correction coefficient G in the LUT 312, the correction coefficient calculating unit 311 may hold a function that expresses the relationship between the average light source luminance lave and the correction coefficient G, so that the correction coefficient G can be calculated by the function, based on the average light source luminance lave.

The correction coefficient calculated by the light source luminance correcting unit 311 is output to the correction coefficient multiplying unit 313. The correction coefficient multiplying unit 313 multiplies the luminance of each light source 22 by the correction coefficient to obtain the corrected light source luminance 105. More specifically, the correction coefficient multiplying unit 313 calculates the corrected light source luminance 105 as follows:

$$I_C(i)=G\times I(i) \tag{5}$$

where Ic(i) represents the $i^{th}$ corrected light source luminance 105. As is evident from this, if the correction coefficient G is 1, the light source luminance I(i) calculated by the light source luminance calculating unit 11 is directly output as the corrected light source luminance Ic(i). If the correction coefficient G is 0.5, the half value of the light source luminance I(i) is output as the corrected light source luminance Ic(i).

When the average light source luminance Iave is high, the correction coefficient G is set to 0.5, which means that the backlight 23 is lit with half the maximum luminance obtained when all light sources 22 are simultaneously lit. This suppresses glare. When the whole screen luminance, obtained when all light sources 22 of the backlight 23 are simultaneously lit, is, for example, 1,000 cd/m$^2$, it is reduced to 500 cd/m$^2$ if the correction coefficient G is set to 0.5.

In contrast, when the average light source luminance Iave is low, the correction coefficient G is set to 1.0, which means that all light sources 22 are lit on the assumption that the screen luminance exhibits the maximum value of 1,000 cd/m$^2$. As a result, the light sources 22 are brightly lit with high luminance, which enables such highly dynamic display as in a CRT that displays bright image areas brightly and dark image areas darkly.

A description will now be given of consumption of power. If the average light source luminance Iave is identical to the maximum value of "1023," the light source luminance I(i) is multiplied by the correction coefficient G of 0.5. In this case, the consumption of power is 0.5 (=0.5×1023/1023) of the case where the average light source luminance Iave is "1023" and the light source luminance I(i) is not corrected (i.e., the correction coefficient G is set to 1.0).

In contrast, when the average light source luminance Iave is a very low value of, for example, "100," even if the correction coefficient G is 1.0, the consumption of power is 0.1 (=1.0×100/1023), which is 1/10 the power consumption of the case where the average light source luminance Iave is "1023" and the light source luminance I(i) is not corrected (i.e., the correction coefficient G is set to 1.0). Accordingly, even if display is performed supposing that the maximum luminance of the screen is approx. 1,000 cd/m$^2$, the power consumption will be greatly reduced, compared to the case where the maximum luminance is approx. 500 cd/m$^2$.

Further, by setting the maximum power consumption of the backlight 23 to 0.5, which is the consumption of power when the average light source luminance Iave is "1023," the correction coefficient G can be set so that the consumption of power is always 0.5 or less. Specifically, the correction coefficient G is determined to satisfy the following expression:

$$G \leq \frac{0.5 \times 1023}{I_{ave}} \tag{6}$$

Figure 8:
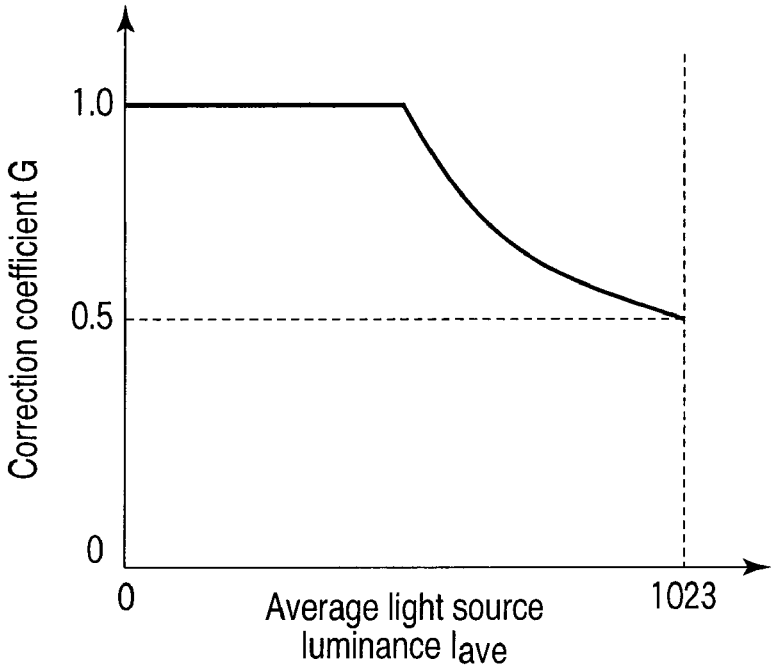
FIG. 8 is a graph illustrating another relationship example between the average light source luminance and the correction coefficient in the first embodiment.

FIG. 8 shows the relationship between the average light source luminance Iave and the maximum value of the correction coefficient G that satisfies the expression (6). By setting the correction coefficient G as shown in FIG. 8, a display with the maximum screen luminance of 1,000 cd/m$^2$ can be realized at the consumption of power not more than that required for realizing the maximum screen luminance of approx. 500 cd/m$^2$.

(Controller 15)

The controller 15 controls the timing of writing the transformed image 104 to the liquid crystal panel 21, and the timing of applying the corrected light source luminance 105 to the light sources 22 of the backlight 23.

The controller 15 adds some synchronization signals (e.g., vertical and horizontal synchronization signals) generated therein and necessary to drive the liquid crystal panel 21 to the transformed image 104 output from the signal level transform unit 12, thereby generating a complex image signal 106 and sending the same to the liquid crystal panel 21. At the same time, the controller 15 generates, based on the corrected light source luminance 105, a light source luminance control signal 107 for lighting the light sources 22 of the backlight 23 with a desired luminance, and sends the signal to the backlight 23.

The type of the light source luminance control signal 107 depends upon the type of the light sources 22 of the backlight 23. In general, cold-cathode tubes or emission diodes (LEDs) are used as the light sources 22 of the backlight 23. The luminances of the light sources can be modulated by controlling a voltage or current applied thereto. In general, however, pulse width modulation (PWM) control for modulating luminance by quickly changing the ratio between the emission period and non-emission period is utilized instead of controlling a voltage or current applied to the light sources. In the first embodiment, for example, LEDs that can be relatively easily controlled in emission intensity are used as the light sources 22 of the backlight 23, and the luminance of the light sources is modulated by PWM control. In this case, the controller 15 generates a PWM control signal as the light source luminance control signal 107, and outputs the same to the backlight 23.

(Image Display Unit 20)

In the image display unit 20, the complex image signal 106 output from the controller 15 is applied to the liquid crystal panel 21 (light modulating element), and the luminance control signal 107 also output from the controller 15 is applied to the light sources 22 of the backlight 23, thereby lighting the backlight 23 and displaying the input image 101. As mentioned above, in the first embodiment, LEDs are used as the light sources 22 of the backlight 23.

As described above, the first embodiment enables high dynamic range display to be realized with a small circuit scale, with the power consumption minimized. In other words, regarding the dynamic range of display, such dynamic range as in CRTs can be realized by modulating the luminance of each light source 22 in accordance with the input image 101, and transforming the signal level of the input image 101.

Further, increases in the power consumption of the backlight 23 can be suppressed by calculating a correction coefficient that assumes a lower value as the average light source luminance is greater, multiplying the light source luminance by the correction coefficient to obtain a corrected light source luminance, and generating the luminance control signal 107 based on the corrected light source luminance.

Yet further, in the prior method of calculating the average luminance (e.g., APL) of the entire image from the input image, and controlling the light source luminance based on the APL, the circuit scale is inevitably increased by the calculation of the APL. In contrast, in the first embodiment, the average light source luminance is calculated instead of the average luminance of an image, and hence it is sufficient if the average of the luminances of the light sources is calculated. Accordingly, the cost of calculating the average light source luminance is low, which enables the average light source luminance to be calculated by a much smaller circuit scale even in the case of an HDTV image.

Second Embodiment

The basic configuration of an image processing apparatus according to a second embodiment is similar to that of the first embodiment, except for the structure of the light source luminance control signal 107 output from the controller 15. Referring now to FIGS. 9 to 14, the structure of the light source luminance control signal 107 according to the second embodiment will be described in detail. The other structures or configurations are similar to those of the first embodiment, and hence will not be described.

(Controller 15)

The light source luminance control signal 107 of the second embodiment is constructed such that emission periods and non-emission periods are set in one frame period of the input image 101, the start times of the emission and non-emission periods are set different in each column of light sources 22, i.e., in the vertical direction of the screen.

Figure 9:
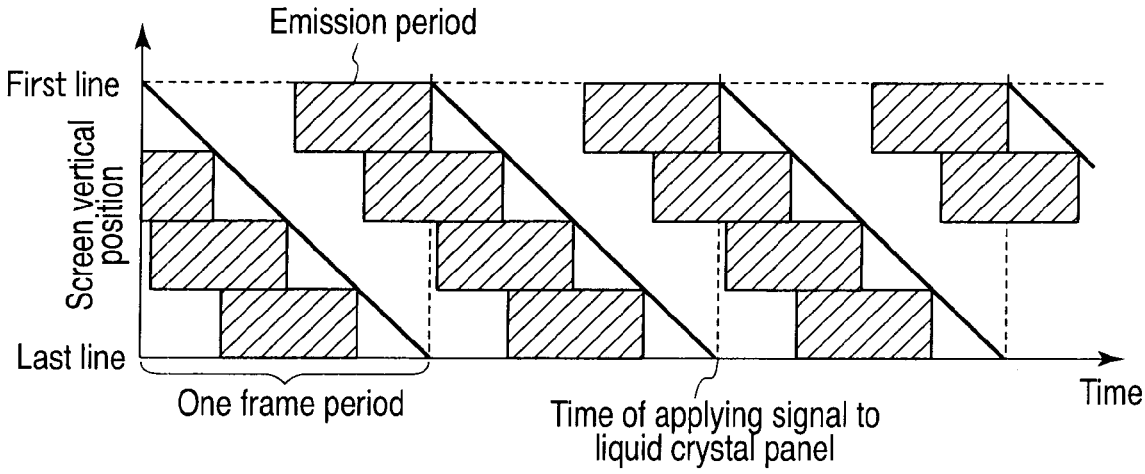
FIG. 9 is a view illustrating a relationship example between the times of applying an image signal to a liquid crystal panel and the emission periods of the light sources of the backlight in a second embodiment.

FIG. 9 shows the relationship between the timing of applying an image signal to the liquid crystal panel 21 and the emission periods of the light sources 22. In FIG. 9, the vertical axis indicates the vertical position on the screen, and the horizontal axis indicates the time. The times of applying the image signal to the liquid crystal panel 21 are gradually retarded from the first line to the last line of the panel 21. More specifically, when a preset blanking period elapses after signal application to the last line of the current frame is finished, signal application to the first line of the next frame is started. However, for facilitating the description, the blanking period is set to zero.

Since emission/non-emission is controlled per a preset number of lines included in the liquid crystal panel 21, a preset number of light sources 22, which correspond to the number of light sources arranged along the vertical axis of the screen of the backlight 23, are set to emit light as shown in FIG. 9. FIG. 9 shows a case where four light sources are arranged along the vertical axis of the screen as shown in FIG. 2. Each light source 22 has its emission/non-emission ratio in one frame period controlled by the light source luminance control signal 107 in accordance with the corrected light source luminance 105.

FIG. 9 shows the case where the non-emission and emission periods are set in the first and second halves of one frame, respectively, and the corrected light source luminance 105 is set to "512" in 10 bit expression. One frame ranges from the start time of applying the image signal to the liquid crystal panel 21 in the current frame, to the start time of applying the image signal to the liquid crystal panel 21 in the next frame.

The start time of the emission period of the light source 22 in one frame period can be arbitrarily set. However, it is preferable to cause the light source 22 to emit light when as long a non-emission period as possible elapses after applying the image signal to the liquid crystal panel 21 in the current frame, as is shown in FIG. 9. Namely, it is sufficient if the start time of applying the image signal in the next frame is fixed as the time of change from the emission period of the light source 22 to the non-emission period, and the start time of the emission period is determined in accordance with the corrected light source luminance 105. This is based on the following reason:

In the liquid crystal panel 21, because of the response properties of the liquid crystal material, when a preset period elapses after the image signal is applied, a desired transmittance is reached. Since display is performed with a desired luminance if the light source 22 emits light after the liquid crystal panel 21 reaches the desired transmittance, it is desirable that the emission period be set in the second half of one frame period. Further, by gradually shifting the start times of the emission periods of the light sources 22 vertically arranged, the period (non-emission period) between the time of applying the image signal to the liquid crystal panel 21 and the start time of the emission period can be set longer, whereby images can be displayed with a more appropriate luminance.

Figure 10:
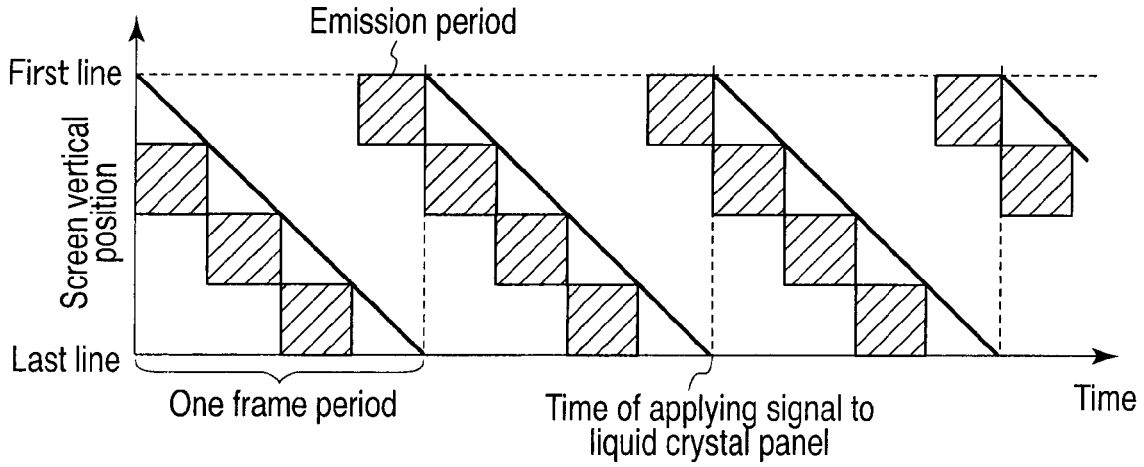
FIG. 10 is a view illustrating another relationship example between the times of applying the image signal to the liquid crystal panel and the emission periods of the light sources of the backlight in the second embodiment.

FIG. 10 shows the relationship between the times of applying the image signal to the liquid crystal panel 21 and the emission periods of the light sources 22. More specifically, FIG. 10 shows the start times of the emission periods assumed when the corrected light source luminance 105 is set to "256." As is evident from the comparison of FIGS. 9 and 10, in the second embodiment, the time of change from the emission period of each light source 22 to the non-emission period of the same is kept constant regardless of the corrected light source luminance 105, and the start time of the emission period is varied in accordance with the corrected light source luminance 105, thereby varying the light source luminance.

By thus setting a preset non-emission period in one frame period, blurring due to holding, which may well occur when a moving picture is displayed on a hold-type display device represented by a liquid crystal display device, can be suppressed, thereby realizing display of a clearer moving picture. In particular, in the second embodiment, when the average of the light source luminances (average light source luminance lave) is high, the correction coefficient G is set to, for example, 0.5 as shown in FIG. 7, with the result that the emission period becomes ½ of one frame period at the maximum. Accordingly, blurring due to holding can be effectively reduced on a brighter screen on which blurring of a moving picture is more visible.

Figure 11:
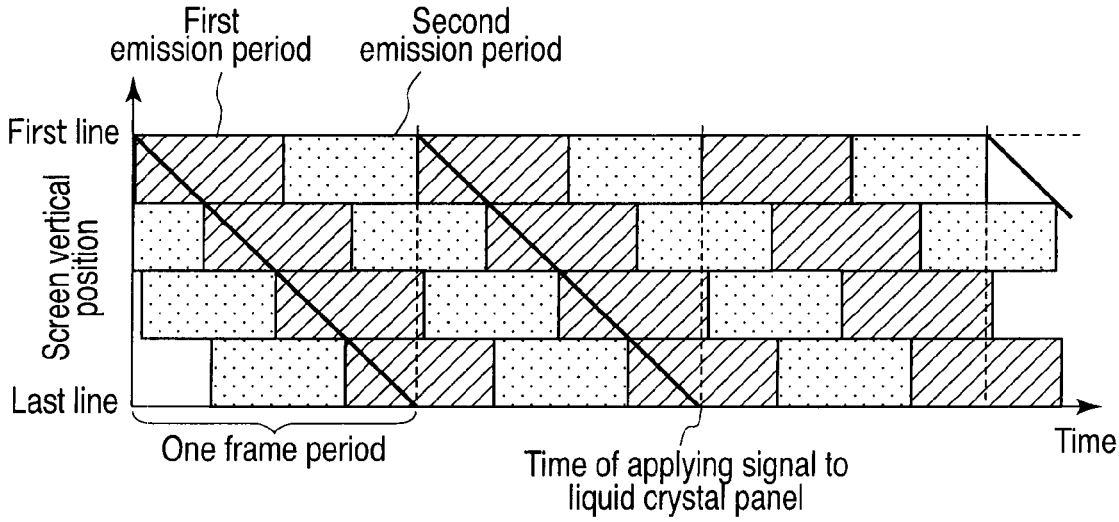
FIG. 11 is a view illustrating a relationship example between the times of applying the image signal to the liquid crystal panel and the emission control periods of the light sources of the backlight in the second embodiment.

The luminance control signal 107 can be modified, as shown in FIG. 11, such that a first emission control period and a second emission control period are set, and different luminance control signals 107 are used in the first and second emission control periods to modulate the light source luminance. In the case of FIG. 11, the first emission control period, for example, is divided into a plurality of periods (sub control periods), and the sub control periods use different emission-period/non-emission-period ratios, thereby modulating the light source luminance. In contrast, in the second emission control period, no such division is performed, but the ratio of the emission period to the non-emission period is varied to modulate the light source luminance as in the cases of FIGS. 9 and 10.

If the corrected light source luminance 105 is lower than a preset threshold value, only the first emission control period is used to modulate the light source luminance, whereas if it is higher than the preset threshold value, both the first and second emission control periods are used to modulate the light source luminance.

Figure 12:
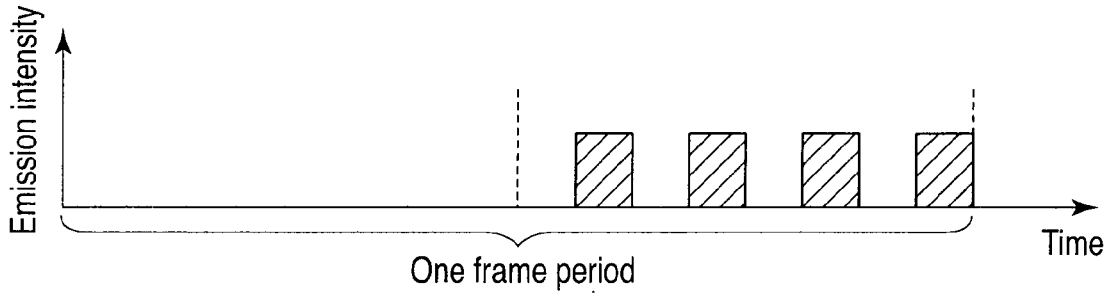
FIG. 12 is a view useful in explaining a second emission control period in FIG. 11.

For instance, if the threshold value is "512" and the corrected light source luminance 105 is "256," the light source luminance is modulated in the first emission control period, and the second emission control period is set as the non-emission period, as is shown in FIG. 12. In the case of FIG. 12, the first emission control period is further divided into four sub control periods, and 50% of each sub control period is set as the emission period, and the remaining 50% is set as the non-emission period, thereby causing the light source 22 to emit light in accordance with the corrected light source luminance 105 of "256."

Figure 13:
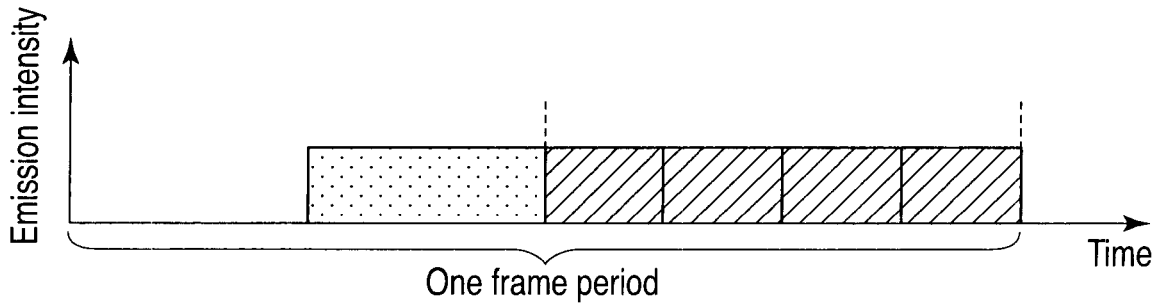
FIG. 13 is a view useful in explaining a first emission control period in FIG. 11.

In contrast, if the corrected light source luminance 105 is "768," emission control is performed as shown in FIG. 13. Namely, 100% of the first emission control period is set as the emission period, and 0% of the same is set as the non-emission period, namely, the light source 22 is kept in the emission state. Further, 50% of the second emission control period is set as the emission period, and the remaining 50% is set as the non-emission period. As a result, emission corresponding to the corrected light source luminance 105 of "768" is realized.

When the light source luminance is modulated by executing the emission period control as shown in FIGS. 9 and 10, the emission period and the non-emission are greatly varied in accordance with the corrected light source luminance 105, which means that the amount of occurrence of blurring in moving picture is greatly varied in accordance with the corrected light source luminance 105. In contrast, when the light source luminance is modulated as shown in FIGS. 12 and 13, if the corrected light source luminance 105 is not more than the preset threshold value, the second emission control period, which will greatly influence the amount of occurrence of blurring in moving picture, is kept in the non-emission state. As a result, the amount of occurrence of blurring in moving picture is kept constant, which further stabilizes the quality of the moving picture.

Figure 14:
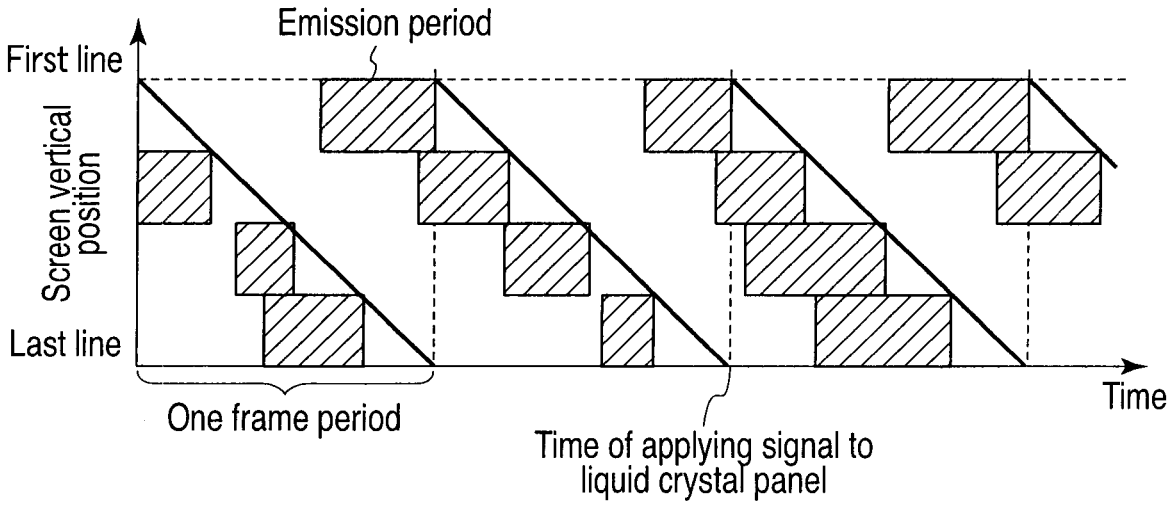
FIG. 14 is a view illustrating yet another relationship example between the times of applying the image signal to the liquid crystal panel and the emission periods of the light sources of the backlight in the second embodiment.

For facilitating the description, FIGS. 9 and 10 show examples in which the luminance of the entire backlight 23 is uniformly modulated. Actually, however, different corrected light source luminances 105 are set for the light sources 22 in accordance with the input image 101. Accordingly, the light sources 22 at different positions emit light for different emission periods at different times, as is shown in FIG. 14.

As described above, the second embodiment can realize display of highly dynamic range, like a CTR, at a small circuit scale with an increase in the consumption of power minimized, as in the first embodiment. In addition to this, the second embodiment can effectively reduce blurring in moving picture.

Third Embodiment

Figure 15:
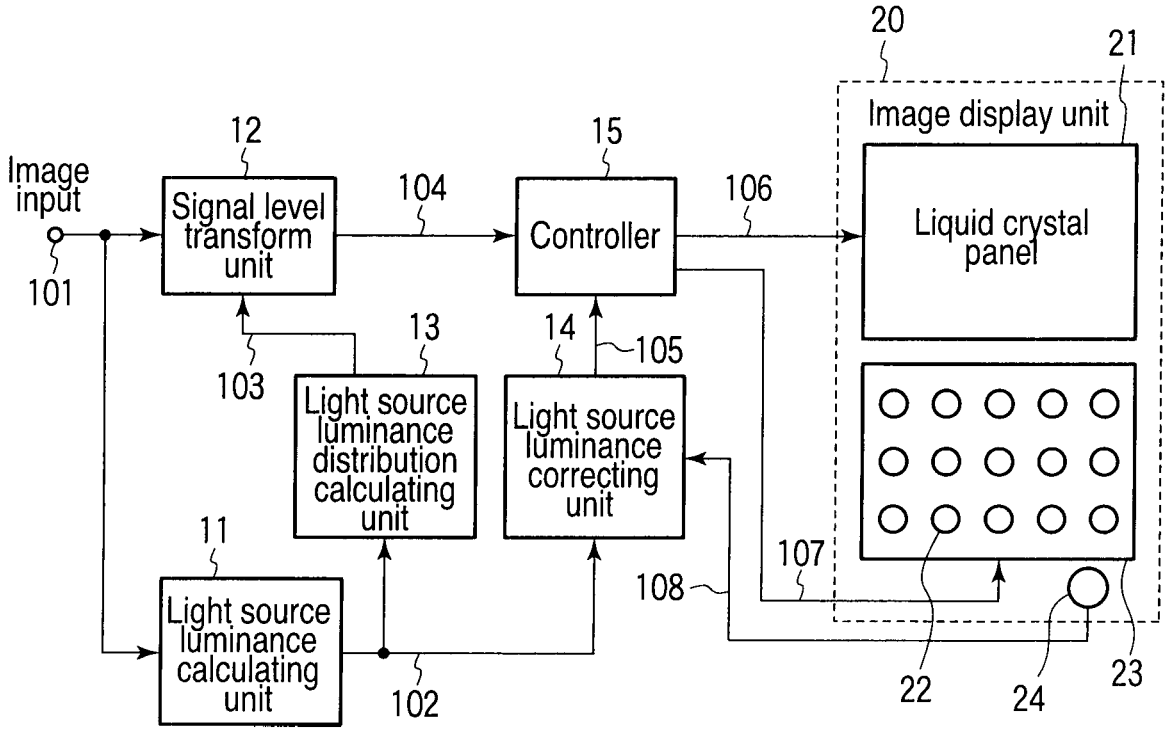
FIG. 15 is a block diagram illustrating an image display apparatus including an image processing apparatus, according to a third embodiment.

FIG. 15 shows an image display apparatus with the image processing apparatus of the second embodiment. An image processing apparatus according to a third embodiment has a structure basically similar to that of the first embodiment shown in FIG. 1. The third embodiment differs from the first embodiment mainly in that in the former, the image display unit 20 includes a luminance sensor 24, and each corrected light source luminance 105 is calculated by the light source luminance correcting unit 14, based on the corresponding light source luminance 102 calculated by the light source luminance calculating unit 11, and on an illumination intensity signal 108 output from the illumination intensity sensor 24. The light source luminance correcting unit 14 of the third embodiment will be described in detail. The other elements are similar to those of the first embodiment, and hence will not be described.

(Light Source Luminance Correcting Unit 14)

In the third embodiment, the light source luminance correcting unit 14 receives the luminance signal 108 from the illumination intensity sensor 24 installed in the image display unit 20, as well as the light source luminances 102 from the light source luminance calculating unit 11. The illumination intensity signal 108 indicates the illumination intensity of a viewing environment, such as an indoor environment in which the image display apparatus is installed. The light source luminance correcting unit 14 calculates the corrected light source luminances 105 based on the light source luminances 102 and the illumination intensity signal 108.

Figure 16:
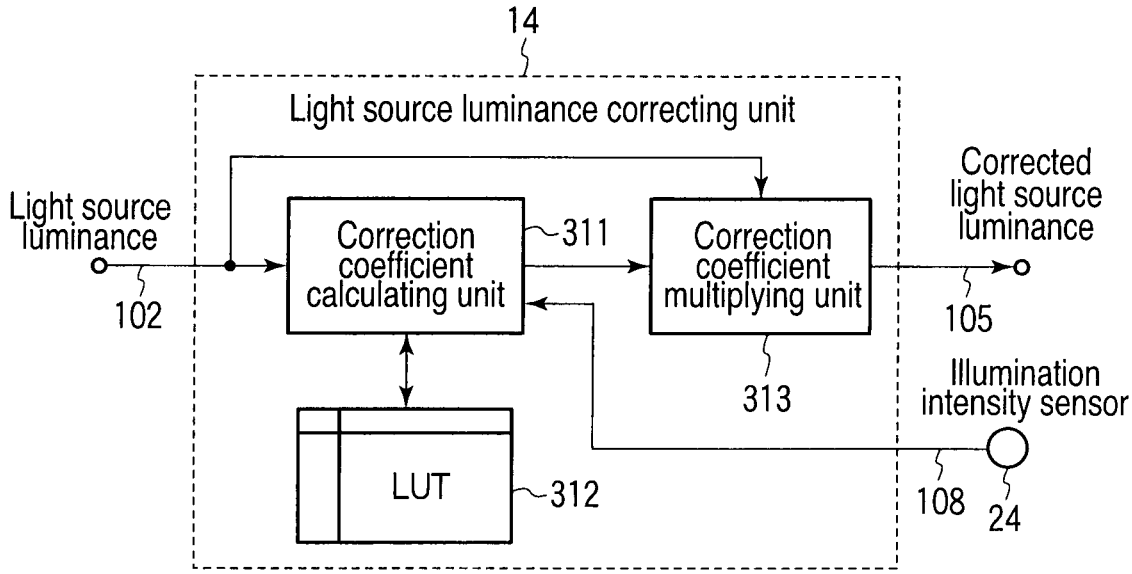
FIG. 16 is a block diagram illustrating in detail a light source luminance correcting unit in the third embodiment.

FIG. 16 shows a specific example of the light source luminance correcting unit 14 according to the third embodiment. The correction coefficient calculating unit 311 calculates the average value (hereinafter, "the average light source luminance lave") of the luminances 101 of the light sources 22 for a preset period, e.g., one frame period, as in the first embodiment. Further, with reference to a LUT 312, the correction coefficient calculating unit 311 calculates a correction coefficient G, based on the average light source luminance lave and the value S of the illumination intensity signal 108 from the illumination intensity sensor 24.

Figure 17:
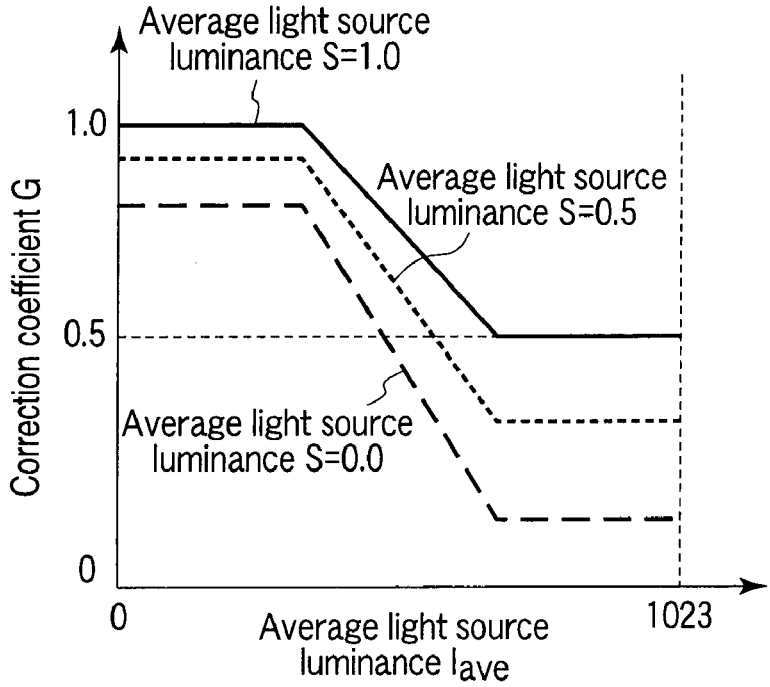
FIG. 17 is a graph illustrating relationship examples between the average light source luminance and the correction coefficient, which are obtained in the third embodiment using luminance as a parameter.

Referring then to FIG. 17, a specific example of the LUT 312 will be described. This LUT 312 differs from that shown in FIG. 6 in that in the former, correction coefficients G and average light source luminances lave, which correspond to illumination intensities S, are stored in association with each other. The illumination intensity S is set to a reference value of 1.0 when the viewing environment is sufficiently bright. The correction coefficient G is set lower as the illumination intensity S is reduced.

When the average light source luminance lave is high, the viewer feels too bright the image displayed on the image display unit 20, if the illumination intensity S is reduced. Accordingly, in an area in which the average light source luminance lave is high, the correction coefficient G is drastically reduced as the illumination intensity S is reduced.

In contrast, when the average light source luminance lave is low, the viewer does not feel so bright the image displayed on the image display unit 20, even if the illumination intensity S is reduced. This is because in this case, the image displayed on the image display unit 20 is not so bright from the beginning. Accordingly, when the average light source luminance lave is not so high, the correction coefficient G is not drastically reduced as the illumination intensity S is reduced.

The relationship between the average light source luminance lave, the correction coefficient G, and the illumination intensity S is not limited to that of FIG. 17. Delicate control can be realized if a larger number of different relationships between the average light source luminance Iave, the correction coefficient G, and the illumination intensity S are held in the LUT 312.

Alternatively, the average light source luminance Iave and the correction coefficient G may be stored in association with each other for each of the illumination intensities S set discretely in the LUT 312 as shown in FIG. 17, and the illumination intensities S that are not set in the LUT may be calculated by interpolation based on the stored correction coefficients G, thereby calculating correction coefficients G corresponding to arbitrary illumination intensity S.

The correction coefficient multiplying unit 313 multiplies the luminance 102 of each light source 22 by the thus calculated correction coefficient G as in the first embodiment to calculate the corrected light source luminance 105.

A description will now be given of a modification of the method of setting the correction coefficient G based on the illumination intensity signal 108 from the illumination intensity sensor 24. In the aforementioned example, one correction coefficient is used for the luminances of the light sources 22 per one frame. In contrast, in this modification, correction coefficients are used for the respective light source luminances 102 calculated by the light source luminance calculating unit 11, i.e., for the respective light sources 22.

Figure 18:
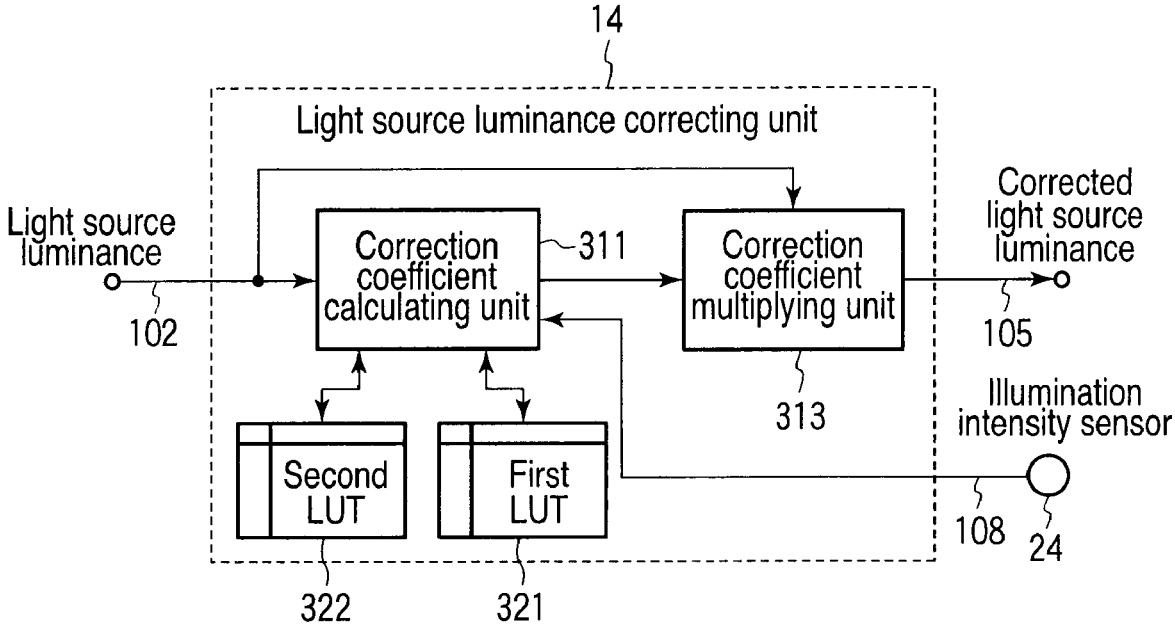
FIG. 18 is a block diagram illustrating a modification of the light source luminance correcting unit of the third embodiment.
Figure 19:
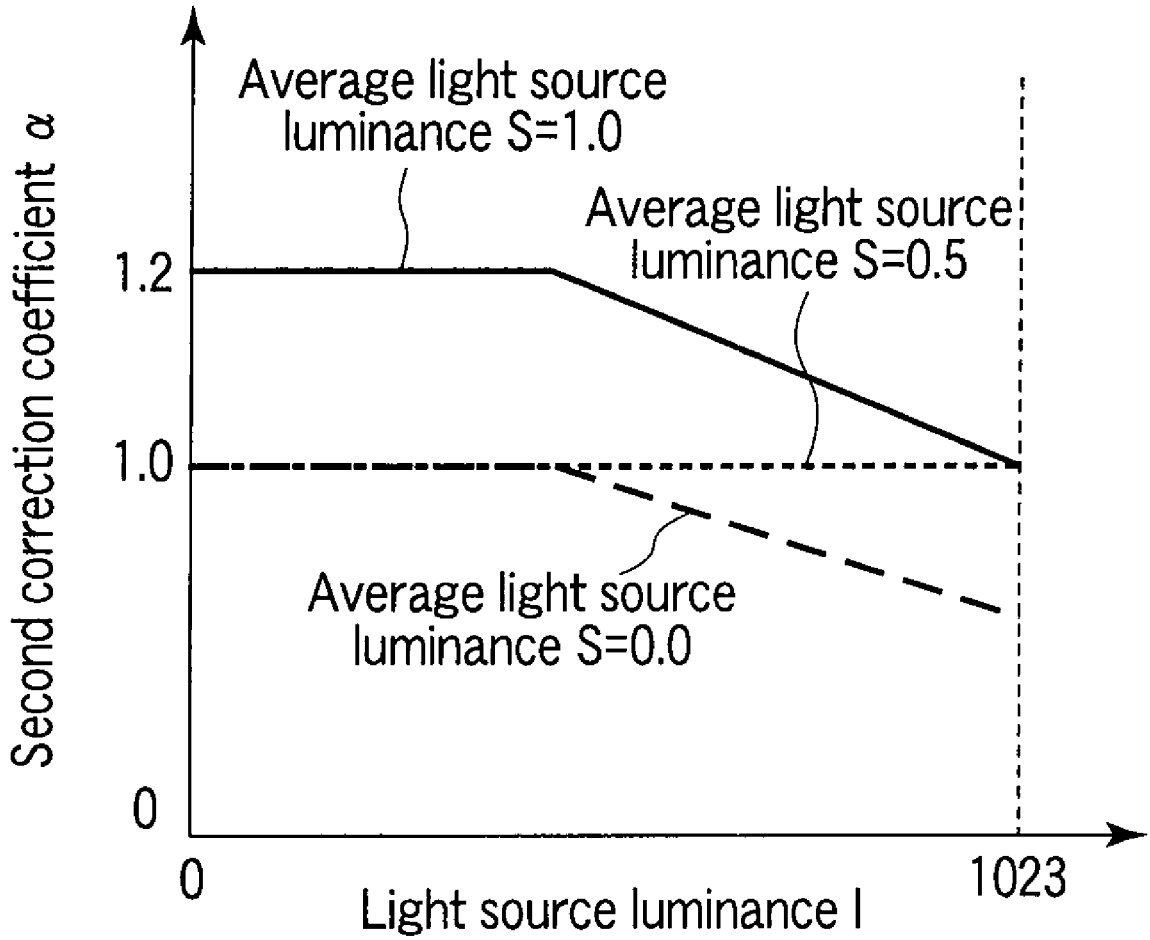
FIG. 19 is a graph illustrating relationship examples between the average light source luminance and the second correction coefficient, which are obtained in the third embodiment using luminance as a parameter.

FIG. 18 shows a light source luminance correcting unit 14 according to the modification of the third embodiment. This unit 14 comprises a first LUT 321 and a second LUT 322. The first LUT 321 holds the average light source luminance lave and a first correction coefficient G in association with each other per illumination intensity S, as is shown in FIG. 17. The second LUT 322 holds the luminances of the light sources and second correction coefficients $\alpha$ associated therewith per illumination intensity S, as is shown in FIG. 19.

The correction coefficient multiplying unit 313 firstly refers to the first LUT 321 to obtain the first correction coefficient G based on the average light source luminance lave and the illumination intensity S. Thereafter, the correction coefficient multiplying unit 313 refers to the second LUT 322 to obtain the second correction coefficients α based on the luminances I(i) of the light sources 22 and the illumination intensity S. After that, the first and second correction coefficients G and α are multiplied to calculate correction coefficients g(i) for the respective light sources 22, as expressed by the following equation:

$$g(i)=\alpha G \tag{7}$$

The function of the second correction coefficients α will now be described. For instance, if the luminances of most light sources 22 are calculated at high, and the luminances of only part of them are calculated at low, the average light source luminance Iave is high. In this case, if the illumination intensity S is high, i.e., if the viewing environment is bright, a relatively small first correction coefficient G is selected from the first LUT 321 to suppress the glare of the screen. Accordingly, if the light source luminances 102 are multiplied by this correction coefficient G, most light sources 22 are corrected to appropriate luminances. In contrast, part of the light sources 22, which have low luminances, are set to excessively dark luminances by the first correction coefficient G although the viewing environment is bright, with the result that the part of the image, in which the light source luminances are set low, becomes hard to see.

To avoid this, the second LUT 322 holds the relationship between the light source luminances and the second correction coefficients α, in which relationship each of the second correction coefficients α, by which a lower luminance is multiplied when the illumination intensity S is high, is set larger. By virtue of the thus-set second correction coefficients α, part of the light sources 22 that have low luminances are prevented from being corrected to excessively reduced luminances.

On the other hand, if the luminances of most light sources 22 are calculated at low, and the luminances of only part of them are calculated at high, the average light source luminance Iave is low. In this case, if the illumination intensity S is low, i.e., if the viewing environment is dark, a relatively large first correction coefficient G is selected from the first LUT 321 to enable high dynamic range display. Accordingly, if the light source luminances 102 are multiplied by this correction coefficient G, part of the light sources 22, which have high luminances, are set to excessively high luminances by the first correction coefficient G although the viewing environment is dark, with the result that the viewers feel the entire display image too bright.

In consideration of the above, the second LUT 322 are set to hold the relationship between the light source luminances and the second correction coefficients α, in which relationship each of the second correction coefficient α, by which a higher luminance is multiplied when the illumination intensity S is low, is set smaller. By virtue of the thus-set second correction coefficients α, part of the light sources that have high luminances are prevented from being corrected to excessively high luminances.

The corrected light source luminance 105 for the light source 22 is obtained by multiplying the luminance 102 of the light source 22 by the correction coefficient g(i) given by the equation (7) related to the first correction coefficient G and the second correction coefficient(s) α. Namely, the corrected light source luminance 105 is given by $$I_C(i)=g(i)\times I(i) \tag{8}$$

where Ic(i) represents the $i^{th}$ corrected light source luminance 105, and I(i) represents the $i^{th}$ light source luminance 102.

By thus calculating correction coefficients for the respective light sources 22, the light sources can be set to appropriate luminances in accordance with the viewing environment, even if low and high light source luminances coexist in each frame.

As described above, the third embodiment enables high dynamic range display as in CRTs to be realized with a small circuit scale, with the power consumption minimized, as in the first and second embodiments. The third embodiment further enables appropriate display luminances to be realized in accordance with the viewing environment.

Although the first to third embodiments employ the transmissive liquid crystal display apparatuses that each comprise the liquid crystal panel 21 and the backlight 23, the embodiment is not limited to them, but is applicable to various image display apparatuses. For instance, the embodiment is also applicable to a projection type liquid crystal display apparatus that comprises a liquid crystal panel as a light modulating element, and a light source unit such as a halogen light source. The embodiment is further applicable to another projection type image display apparatus that uses, as a light modulating element, a digital micro mirror device for displaying images by controlling reflection of light from a halogen light source as a light source unit.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image display apparatus comprising:

an image display unit comprising a light source unit provided with a plurality of light sources, each configured to be controlled respectively, and a liquid crystal panel configured to display on a display area;

a luminance calculation unit configured to calculate a light source luminances of the light sources based on signal levels of divided areas into which the display area is virtually divided;

a luminance distribution calculation unit configured to calculate an entire luminance distribution of the light source unit;

a transform unit configured to transform a signal level of the input image into a transformed image based on the entire luminance distribution;

a luminance correction unit configured to calculate, as a representative value, an average value or a sum of the light source luminances, to calculate a correction coefficient which is set smaller as the representative value is increased, to correct each of the light source luminances by the correction coefficient; and a controller unit configured to control the liquid crystal panel and the light source unit.

2. An image display apparatus including a light source unit with a plurality of light sources having luminances thereof modulated in accordance with a luminance control signal, and a light modulating element which modulates light from the light source unit in accordance with an image signal, the apparatus comprising:

a luminance calculation unit configured to calculate a light source luminance of each of the light sources based on information indicating a signal level of each of divisional areas into which the input image is divided in association with the light sources;

a luminance distribution calculation unit configured to calculate an entire luminance distribution of the light source unit by synthesizing individual luminance distributions indicating the luminances of the light sources;

a transform unit configured to transform a signal level of each pixel of the input image into a transformed image based on the entire luminance distribution;

a luminance correction unit including a correction coefficient calculation unit configured to calculate a correction coefficient, the correction coefficient being set smaller as an average value or a sum of the luminances of the light sources is increased, the luminance correction unit being configured to multiply each of the luminances of the light sources by the correction coefficient to produce a corrected light source luminance;

a controller unit configured to generate the image signal based on the transformed image, and generate the luminance control signal to based on the corrected light source luminance; and an image display unit including a light source unit provided with a plurality of light sources having luminances thereof adjusted in accordance with a luminance control signal, and including a light modulating element configured to modulate light from the light source unit in accordance with an image signal.

3. The apparatus according to claim 2, wherein the light modulating element is configured to modulate light from the light source unit when the image signal is applied thereto per frame; and the controller unit is configured to construct the luminance control signal to instruct each of the light sources of the light source unit to sequentially have a non-emission period and an emission period in a period ranging from a first start time of applying the image signal of a current frame to the light modulating element to a second start time of applying the image signal of a subsequent frame to the light modulating element, and to change a ratio of the non-emission period to the emission period to control luminances of the light sources.

4. The apparatus according to claim 3, wherein the controller is configured to construct the luminance control signal:

to instruct each of the light sources of the light source unit to sequentially have a first emission control period and a second emission control period in the period ranging from the first start time to the second start time;

to instruct each of the light sources to sequentially have a non-emission period and an emission period in each of a plurality of sub control periods into which the first emission control period is divided, and to change a ratio of the non-emission period to the emission period to control the luminances of the light sources, when the corrected light source luminance is lower than a preset threshold value; and to instruct each of the light sources to use the entire first emission control period as an emission period, to sequentially have, in the second emission control period, a non-emission period and an emission period, and to change a ratio of the non-emission period to the emission period to control the luminances of the light sources, when the corrected light source luminance is not lower than the preset threshold value.

5. The apparatus according to claim 3, wherein the transform unit is configured to acquire, from the entire luminance distribution, a pixel-associated light source luminance corresponding to a position of each pixel of the input image, and to acquire a signal level corresponding to a position of each pixel of the transformed image from the pixel-associated light source luminance, and a signal level corresponding to a position of each pixel of the input image.

6. The apparatus according to claim 2, wherein the luminance calculation unit is configured to calculate a first maximum signal level of the input image in each divisional area, to divide the first maximum signal level by a second maximum signal level that the input image can have, to correct the divided first maximum signal level by a gamma value, and to generate the light source luminance.

7. The apparatus according to claim 2, wherein the luminance correction unit includes a lookup table holding the average value or the sum in association with the correction coefficient; and the correction coefficient calculation unit is configured to calculate the average value or the sum from the luminances of the light sources, and calculate the correction coefficient with reference to the lookup table, based on the calculated average value or the calculated sum.

8. The apparatus according to claim 7, wherein the correction coefficient calculated by the correction coefficient calculation unit has a first constant value when the average value or the sum is less than a predetermined threshold value, has a value that is gradually reduced as the average value increases, when the average value or the sum is not less than the predetermined threshold value, and finally has a second value lower than the first value.

9. The apparatus according to claim 7, wherein the correction coefficient calculated by the correction coefficient calculation unit causes power consumption of the light source unit to be not more than power consumption of the light source unit assumed when the average value is maximum.

10. The apparatus according to claim 2, further comprising an illumination intensity sensor configured to detect an illumination intensity of a viewing environment of the image display apparatus, wherein the correction coefficient calculation unit calculates the correction coefficient such that the correction coefficient becomes smaller as the average value or the sum increases, and becomes smaller as the illumination intensity decreases.

11. The apparatus according to claim 2, further comprising an illumination intensity sensor configured to detect an illumination intensity of a viewing environment of the image display apparatus, wherein the correction coefficient calculation unit calculates a first correction coefficient, the first correction coefficient becoming smaller as the average value or the sum increases, and becoming smaller as the illumination intensity decreases;

the correction coefficient calculation unit calculates second correction coefficients, the second correction coefficients becoming smaller as the luminances of the light sources increase, and becoming smaller as the illumination intensity decreases; and the correction coefficient calculation unit multiplies the first correction coefficient by each of the second correction coefficient to calculate another correction coefficient, the another correction coefficient becoming smaller as the average value or the sum increases.

12. The apparatus according to claim 2, wherein the correction coefficient calculation unit is configured to calculate the correction coefficient that is set smaller as the average value or the sum of the luminances of the light sources is increased, the average value or the sum being performed over one frame period of the image signal.

13. An image processing apparatus for an image display apparatus including a light source unit with a plurality of light sources having luminances thereof modulated in accordance with a luminance control signal, and a light modulating element which modulates light from the light source unit in accordance with an image signal, the apparatus comprising:

a luminance calculation unit configured to calculate a light source luminance of each of the light sources based on information indicating a signal level of each of divisional areas into which the input image is divided in association with the light sources;

a luminance distribution calculation unit configured to calculate an entire luminance distribution of the light source unit by synthesizing individual luminance distributions indicating the luminances of the light sources;

a transform unit configured to transform a signal level of each pixel of the input image into a transformed image based on the entire luminance distribution;

a luminance correction unit including a correction coefficient calculation unit configured to calculate a correction coefficient, the correction coefficient being set smaller as an average value or a sum of the luminances of the light sources is increased, the luminance correction unit being configured to multiply each of the luminances of the light sources by the correction coefficient to produce a corrected light source luminance; and a controller unit configured to generate the image signal based on the transformed image, and generate the luminance control signal to based on the corrected light source luminance.

* * * * *